US010971837B2

(12) United States Patent
Jin

(10) Patent No.: US 10,971,837 B2
(45) Date of Patent: Apr. 6, 2021

(54) SUBSTRATE ELECTRICAL CONNECTOR WITH TERMINALS IN ACCOMMODATING HOLES

(71) Applicant: LOTES CO., LTD, Keelung (TW)

(72) Inventor: Zuo Feng Jin, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/867,815

(22) Filed: May 6, 2020

(65) Prior Publication Data

US 2020/0358215 A1 Nov. 12, 2020

(30) Foreign Application Priority Data

May 7, 2019 (CN) ..... 201920641762.8

(51) Int. Cl.
*H01R 12/71* (2011.01)
*H01R 13/11* (2006.01)
(Continued)

(52) U.S. Cl.
CPC ..... *H01R 12/716* (2013.01); *H01R 13/11* (2013.01); *H01R 13/658* (2013.01); *H01R 4/02* (2013.01);
(Continued)

(58) Field of Classification Search
CPC .. H01R 12/714; H01R 12/52; H01R 13/6585; H01R 12/58; H01R 12/585; H01R 2107/00; H01R 43/205; H01R 12/00; H01R 13/6581; H01R 12/73; H01R 12/718; H01R 13/6591; H01R 13/65918; H01R 12/707; H01R 12/775; H01R 13/2457;
(Continued)

(56) References Cited

U.S. PATENT DOCUMENTS 8,033,877 B2 * 10/2011 Di Stefano ..... H05K 3/3436 439/851
8,414,332 B2 * 4/2013 Ju ..... H01R 13/6588 439/607.02

FOREIGN PATENT DOCUMENTS

CN 201450142 U 5/2010
CN 101997190 A 3/2011
(Continued)

*Primary Examiner* — Abdullah A Riyami
*Assistant Examiner* — Justin M Kratt
(74) *Attorney, Agent, or Firm* — Locke Lord LLP; Tim Tingkang Xia, Esq.

(57) ABSTRACT

An electrical connector includes a substrate and multiple terminals. The substrate is provided with multiple accommodating holes running through the substrate vertically. A shielding member is provided on a lower surface of the substrate. The terminals are correspondingly accommodated in the accommodating holes respectively. The terminals include multiple signal terminals and at least one ground terminal. An interval exists between the ground terminal and the shielding member. The ground terminal has a conducting portion extending downward out of a corresponding accommodating hole. The conducting portion is soldered to a main circuit board through a solder, and the solder is in contact with the conducting portion and the shielding member. According to the present invention, the conducting portion of the ground terminal is connected with the shielding member through the solder, thereby reducing a spurious charge, reducing the capacitance, and improving a high frequency.

10 Claims, 15 Drawing Sheets

(51) Int. Cl.

| | |
|---|---|
| ***H01R 13/658*** | (2011.01) |
| *H01R 12/77* | (2011.01) |
| *H01R 12/73* | (2011.01) |
| *H01R 12/70* | (2011.01) |
| *H01R 12/52* | (2011.01) |
| *H01R 13/24* | (2006.01) |
| *H01R 4/28* | (2006.01) |
| *H01R 43/20* | (2006.01) |
| *H01R 12/00* | (2006.01) |
| *H01R 13/03* | (2006.01) |
| *H01R 13/6591* | (2011.01) |
| *H01R 13/6597* | (2011.01) |
| *H01R 12/58* | (2011.01) |
| *H01R 4/02* | (2006.01) |
| *H01R 107/00* | (2006.01) |
| *H01R 13/6585* | (2011.01) |
| *H01R 13/6581* | (2011.01) |

(52) U.S. Cl.

CPC ..... *H01R 4/28* (2013.01); *H01R 12/00* (2013.01); *H01R 12/52* (2013.01); *H01R 12/58* (2013.01); *H01R 12/585* (2013.01); *H01R 12/7005* (2013.01); *H01R 12/707* (2013.01); *H01R 12/7029* (2013.01); *H01R 12/71* (2013.01); *H01R 12/712* (2013.01); *H01R 12/714* (2013.01); *H01R 12/718* (2013.01); *H01R 12/73* (2013.01); *H01R 12/775* (2013.01); *H01R 13/035* (2013.01); *H01R 13/111* (2013.01); *H01R 13/2457* (2013.01); *H01R 13/2485* (2013.01); *H01R 13/6581* (2013.01); *H01R 13/6585* (2013.01); *H01R 13/6591* (2013.01); *H01R 13/6597* (2013.01); *H01R 13/65918* (2020.08); *H01R 43/205* (2013.01); *H01R 2107/00* (2013.01)

(58) Field of Classification Search

CPC ..... H01R 13/6597; H01R 12/7029; H01R 13/2485; H01R 12/712; H01R 13/035; H01R 12/71; H01R 12/7005; H01R 4/28; H01R 12/716; H01R 13/11; H01R 13/658; H01R 4/02

USPC ..... 439/66, 71, 607.08, 607.13, 607.28, 439/81–83, 607.35, 607.36, 607.37

See application file for complete search history.

(56) References Cited

FOREIGN PATENT DOCUMENTS

| | | | |
|---|---|---|---|
| CN | 101420078 | B | 9/2012 |
| CN | 203690613 | U | 7/2014 |
| CN | 108832335 | A | 11/2018 |

* cited by examiner

A-A

B-B

C–C

SUBSTRATE ELECTRICAL CONNECTOR WITH TERMINALS IN ACCOMMODATING HOLES

CROSS-REFERENCE TO RELATED PATENT APPLICATION

This non-provisional application claims priority to and the benefit of, pursuant to 35 U.S.C. § 119(a), patent application Serial No. CN201920641762.8 filed in China on May 7, 2019. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and particularly to a shielded electrical connector.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Chinese Patent No. CN200910305610.1 discloses an electrical connecting device used to be connected with a chip module, which mainly includes a circuit board and a plurality of conductive terminals assembled in the circuit board. An upper surface and a lower surface of the circuit board are plated with metal layers, and are provided with a plurality of terminal holes running through a thickness direction thereof. Conductive layers are provided on inner walls of the terminal holes to be electrically connected with the signal path in the circuit board. The conductive terminals are accommodated in the terminal holes respectively and electrically connected with the conductive layers therein. The conductive terminals include signal terminals and ground terminals, and the two types of terminals have identical structures. Each conductive terminal includes a base, a contact portion and a supporting portion extending obliquely upward and downward from the base respectively, and retaining portions located at two sides of the base and extending perpendicularly. The retaining portions are in contact with the conductive layer and retain the conductive terminal in the corresponding terminal hole. In addition, the contact portion of each conductive terminal has a humpback portion protruding backward, which is not co-planar with the retaining portions. The humpback portion abuts the conductive layer to be in contact therewith. The terminal holes include terminal holes for accommodating the ground terminals and terminal holes for accommodating the signal terminals. The conductive layer on the inner wall of each terminal hole is communicated with the metal layers, thereby achieving a parallel effect of the ground terminals.

An insulating colloid attached to the circuit board is provided at a top portion of each terminal hole. With the arrangement of the insulating colloid, the conductive layer on the inner wall of each terminal hole is electrically isolated from the metal layers.

However, the conductive layer and the humpback portion are in contact with each other, which results in an increased spurious charge, increasing capacitance and affecting a high frequency.

Therefore, a heretofore unaddressed need to design an electrical connector exists in the art to address the aforementioned deficiencies and inadequacies.

SUMMARY

The present invention is directed to an electrical connector capable of reducing capacitance, thereby improving a high frequency.

To achieve the foregoing objective, the present invention adopts the following technical solutions.

An electrical connector includes: a substrate, provided with a plurality of accommodating holes running through the substrate vertically, wherein a shielding member is provided on a lower surface of the substrate; and a plurality of terminals, correspondingly accommodated in the accommodating holes respectively, wherein the terminals comprise a plurality of signal terminals and at least one ground terminal, an interval exists between the ground terminal and the shielding member, the ground terminal has a conducting portion extending downward out of a corresponding one of the accommodating holes, the conducting portion is soldered to a main circuit board through a solder, and the solder is in contact with the conducting portion and the shielding member.

In certain embodiments, each of the terminals has two clamping portions configured to clamp an insertion portion of a mating component and two guide portions formed by extending backward from the clamping portions respectively, a distance between the two guide portions is greater than a distance between the two clamping portions, each of the terminals further has a base lower than the guide portions and an accommodating space right above the base, the accommodating space is located behind the guide portions, and when the insertion portion is clamped by the clamping portions, a portion of the insertion portion lower than top ends of the guide portions protrudes forwards out of the clamping portions to be accommodated in the accommodating space of an adjacent terminal.

In certain embodiments, the insertion portion is ball-shaped, the distance between the two clamping portions of each of the terminals gradually decreases upward from bottom thereof, and a position where the two clamping portions clamp the insertion portion is higher than a virtual horizontal center line of the insertion portion.

In certain embodiments, each of the terminals has at least one fixing portion fixed to a corresponding one of the accommodating holes, and the conducting portion is formed by inclining inward and extending downward from the fixing portion and is partially accommodated in the corresponding one of the accommodating holes.

In certain embodiments, each of the terminals has two fixing portions, a first through slot is formed between front sides of the two fixing portions, and a second through slot is formed between rear sides of the two fixing portions.

In certain embodiments, each of the terminals has two conducting portions provided separately, a first opening is formed between front sides of the two conducting portions, and a second opening is formed between rear sides of the two conducting portions.

In certain embodiments, a cross section of each of the accommodating holes is circular, and a surface of the fixing portion is an arc-shaped surface matched with an inner wall of the corresponding one of the accommodating holes.

In certain embodiments, each of the terminals has two fixing portions, and two protruding portions are respectively provided to protrude from the front sides of the two fixing portions opposite to each other.

In certain embodiments, the shielding member is a metal coating layer, and an inner wall of each of the accommodating holes is insulating.

In certain embodiments, a shielding layer is provided on an upper surface of the substrate, the shielding layer is in contact with the ground terminal, and the shielding member is electrically connected with the shielding layer through the ground terminal.

Compared with the related art, the electrical connector according to certain embodiments of the present invention has the following beneficial effects:

The conducting portion of the ground terminal is connected with the shielding member through the solder, such that the ground terminal is electrically connected with the shielding member, and there is no need to provide a conductive layer on the inner wall of each of the accommodating holes to electrically connect the ground terminal and the shielding member, thereby reducing a spurious charge, reducing the capacitance, and improving a high frequency.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
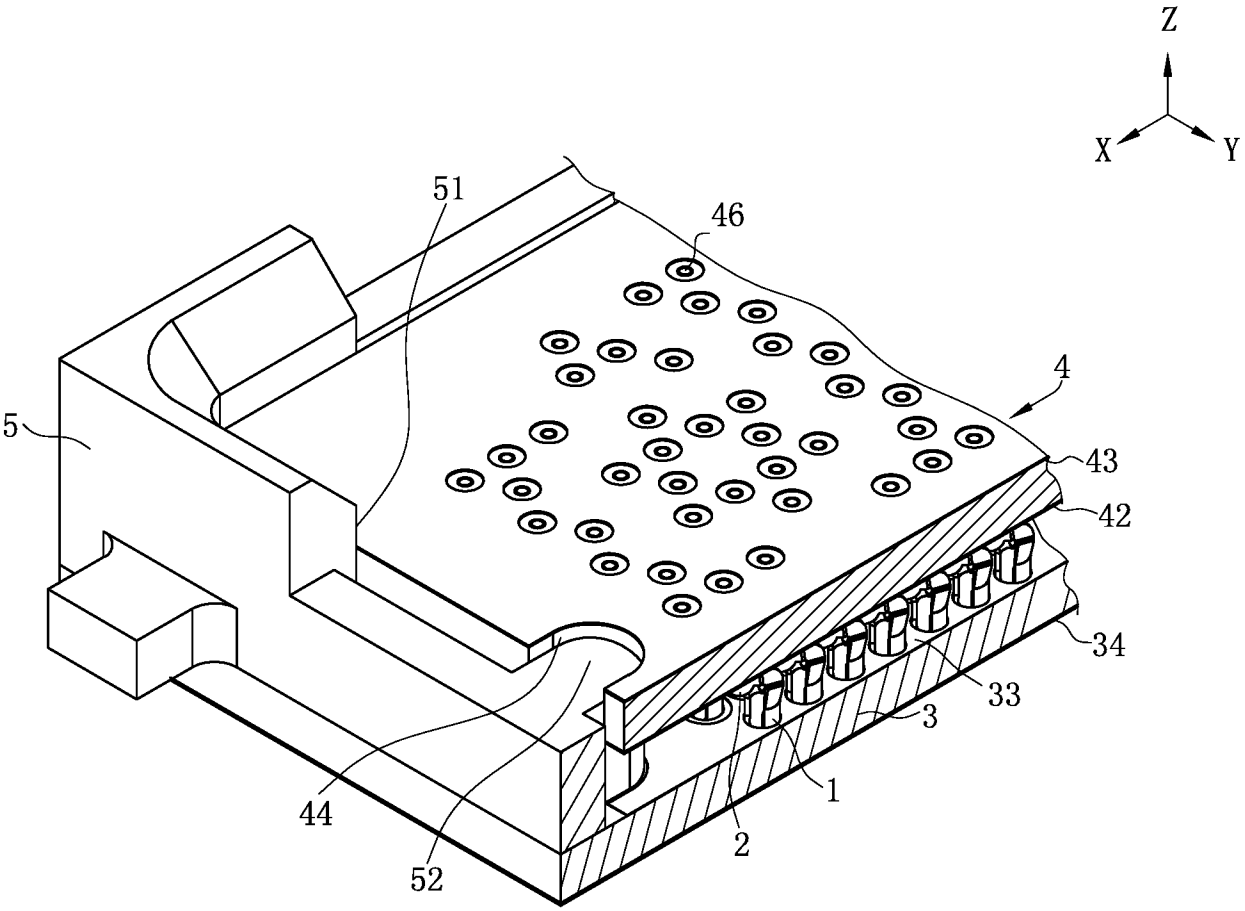
FIG. 1 is a perspective view of an electrical connector assembly according to certain embodiments of the present invention being inserted with a mating component when an insertion portion moves to clamping portions.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-15. In accordance with the purposes of this invention, as embodied and broadly described herein, this invention, in one aspect, relates to an electrical connector.

As shown in FIGS. 1 to 15, a front-rear direction is defined as an X-axis, and the arrow of the X-axis points toward the front direction. A left-right direction is defined as a Y-axis, and the arrow of the Y-axis points toward the left direction. A vertical direction is defined as a Z-axis, and the arrow of the Z-axis points toward the upper direction.

FIGS. 1-15 show an electrical connector 300 and mating component 400 according to certain embodiments of the present invention, which are configured to electrically connect a chip module 500 to a main circuit board 800. The mating component 400 and the electrical connector 300 are provided. The mating component 400 includes a support plate 4 and a plurality of insertion portions 2 provided on the support plate 4 and protruding downward out of the support plate 4. The insertion portions 2 are ball-shaped and are made of copper. In another embodiment, the insertion portions 2 may also be slender cylinder-shaped, flat plate shaped, or of other shapes. The chip module 500 is supported on an upper surface of the support plate 4, and the chip module 500 and the support plate 4 are electrically connected to each other. The electrical connector 300 is located on the main circuit board 800, and includes a substrate 3 and a plurality of terminals 1 accommodated in the substrate 3.

Figure 2:
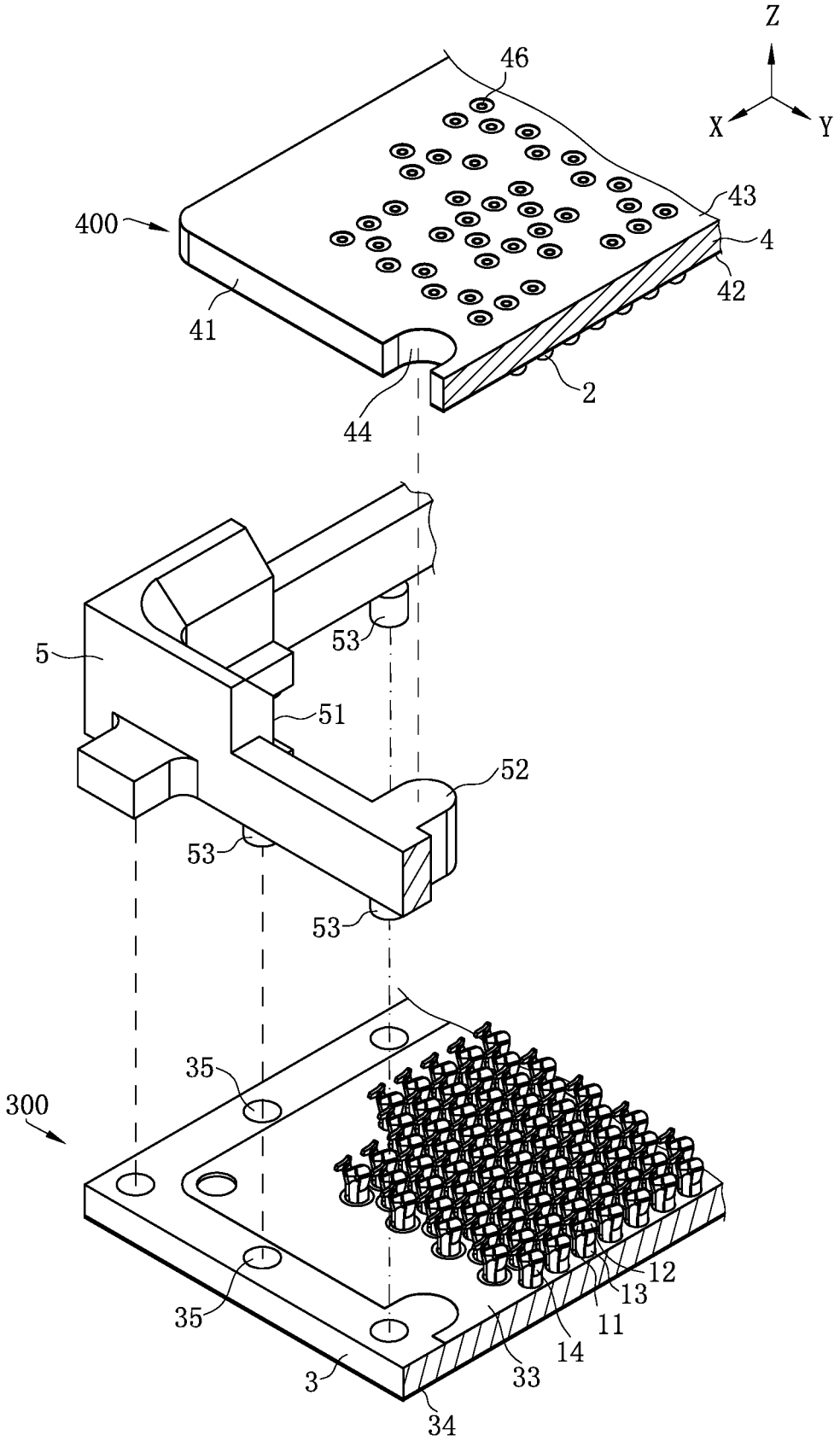
FIG. 2 is an exploded view of FIG. 1.
Figure 7:
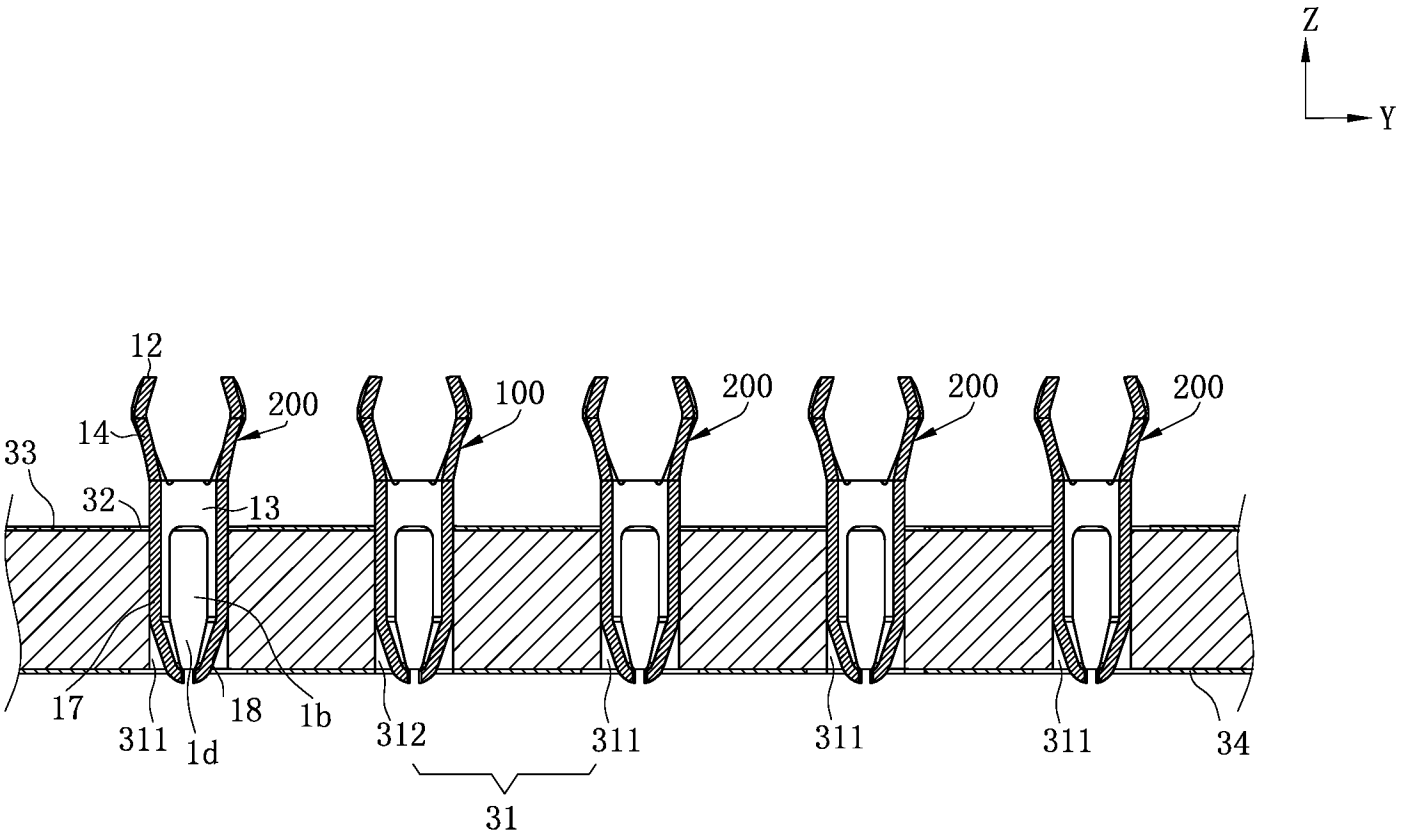
FIG. 7 is a sectional view of FIG. 5 along the B-B direction.
Figure 8:
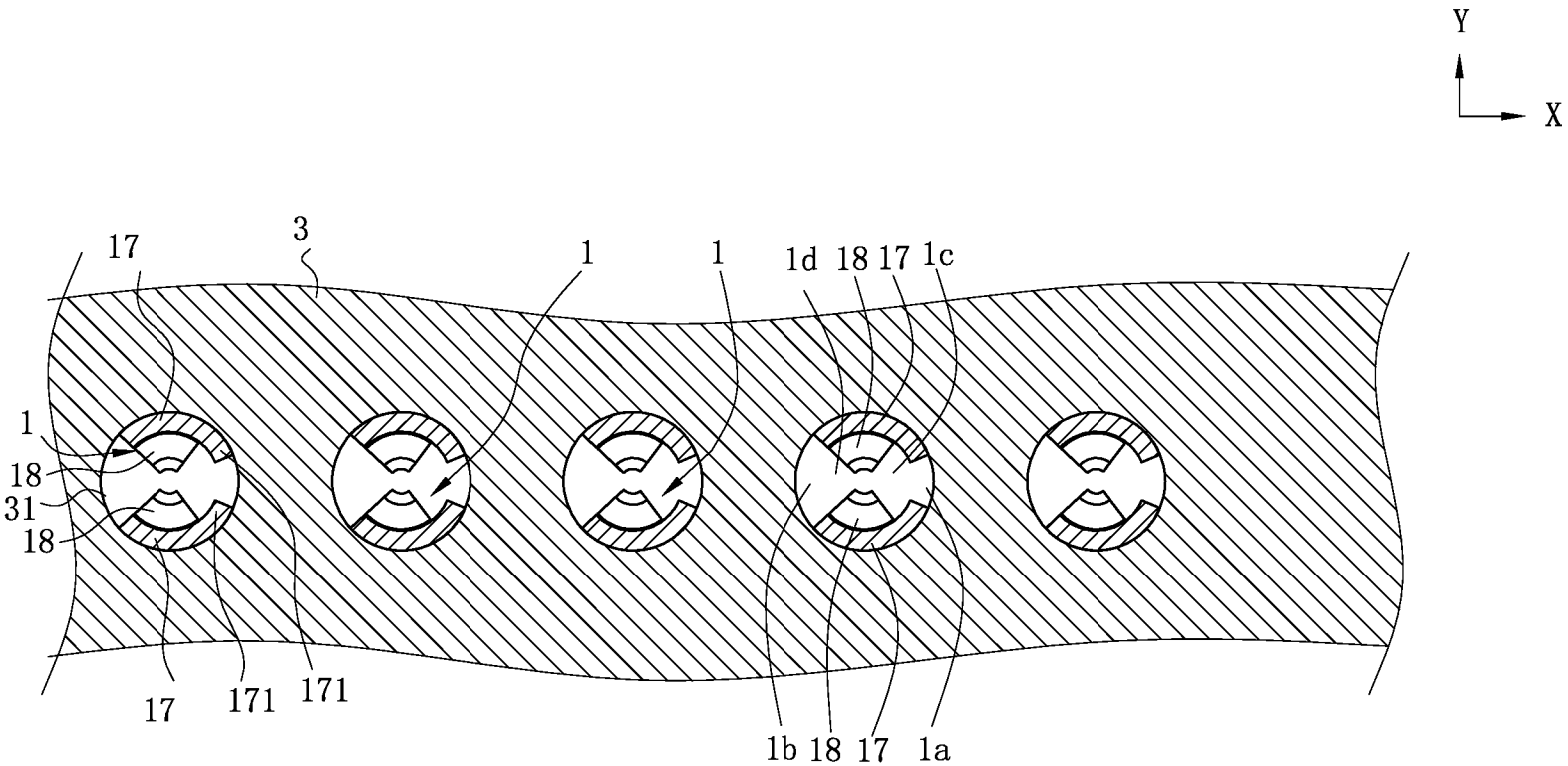
FIG. 8 is a sectional view of FIG. 3 along the C-C direction.

As shown in FIG. 1, FIG. 2, and FIG. 8, the substrate 3 is a circuit board (which is not limited thereto in other embodiments). A plurality of accommodating holes 31 run through the substrate 3 downward from top thereof. The inner walls of the accommodating holes 31 do not have conductive layers. That is, the inner walls of the accommodating holes 31 are insulating. Cross-sections of the accommodating holes 31 are circular. As shown in FIG. 7, the accommodating holes 31 include a plurality of first accommodating holes 311 and a plurality of second accommodating holes 312. A third shielding layer 33 is plated on an upper surface of the substrate 3, and the third shielding layer 33 covers upper edges of the second accommodating holes 312. The upper surface of the substrate 3 has a plurality of insulating regions 32, and each of the insulating regions 32 is provided around a corresponding one of the first accommodating holes 311 and located between the corresponding one of the first accommodating holes 311 and the third shielding layer 33, such that the first accommodating holes 311 are separated from the third shielding layer 33. A lower surface the substrate 3 has a shielding member 34. The shielding member 34 covers lower edges of the second accommodating holes 312, and there are intervals between the fourth shielding member 34 and lower edges of the first accommodating holes 311. In this embodiment, the shielding member 34 is a metal coating layer.

Figure 3:
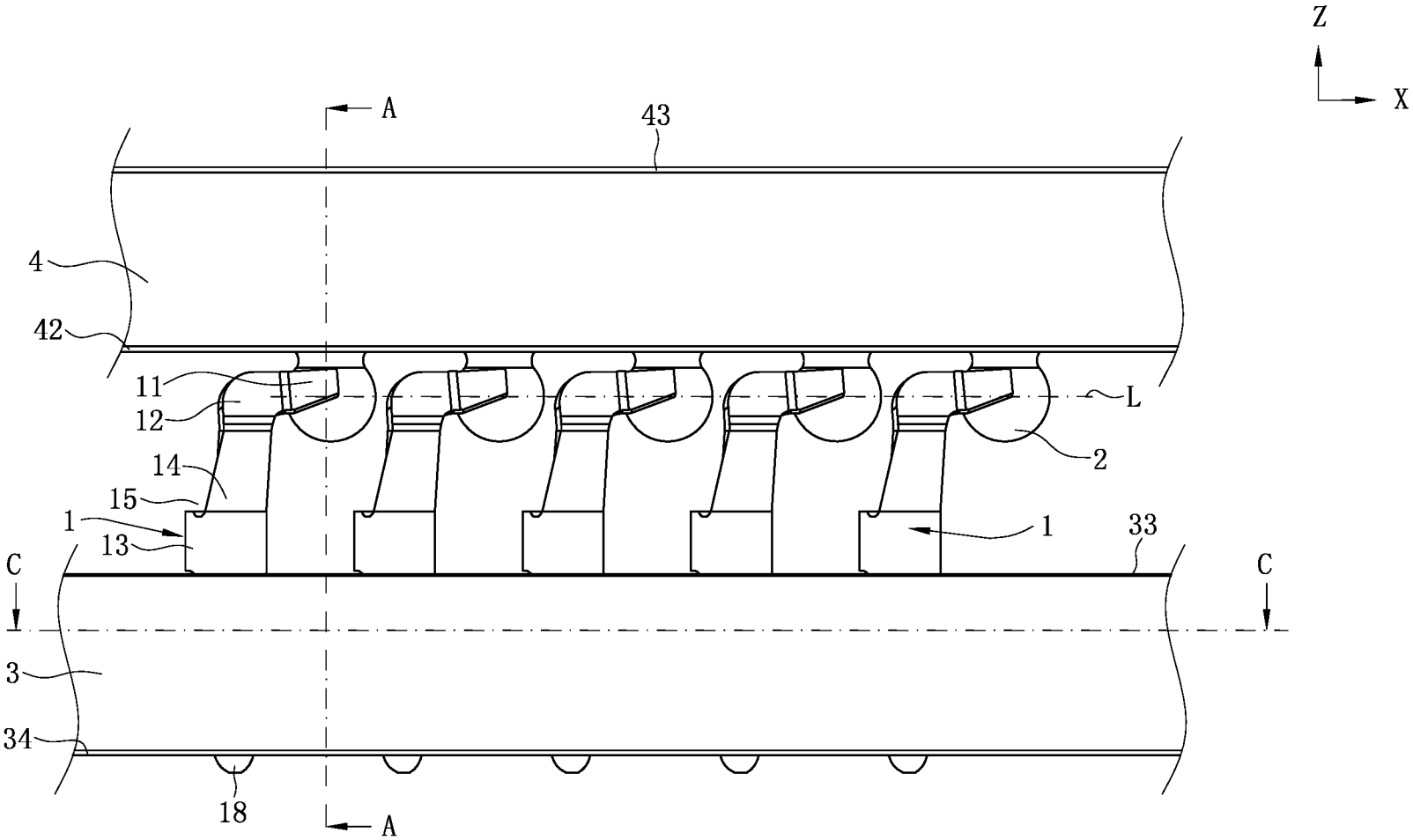
FIG. 3 is a horizontal observational view of FIG. 1.
Figure 4:
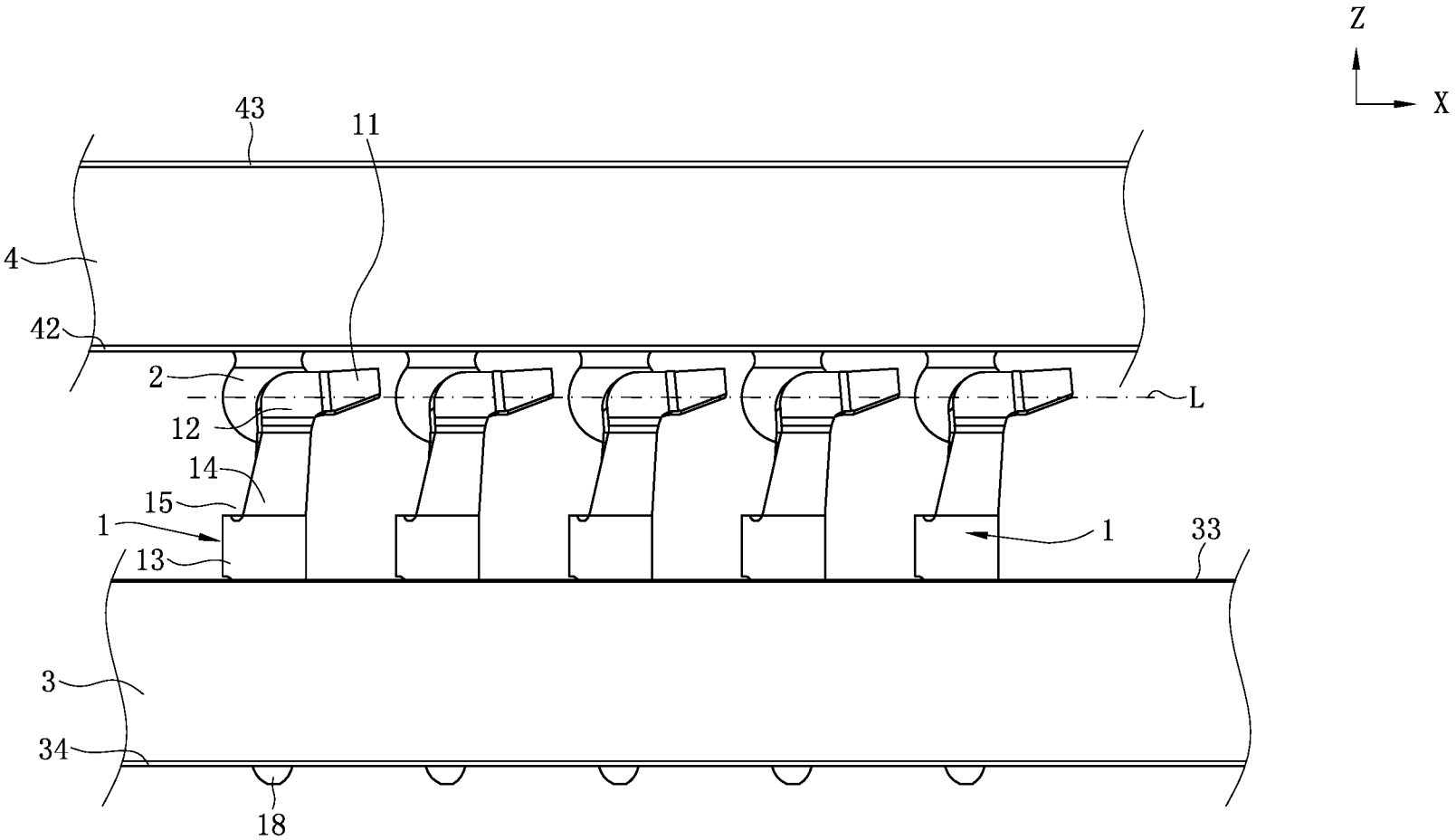
FIG. 4 is a perspective view of the electrical connector assembly according to certain embodiments of the present invention being inserted with a mating component when an insertion portion is inserted downward between two guide portions and has not moved between two of the clamping portions.
Figure 6:
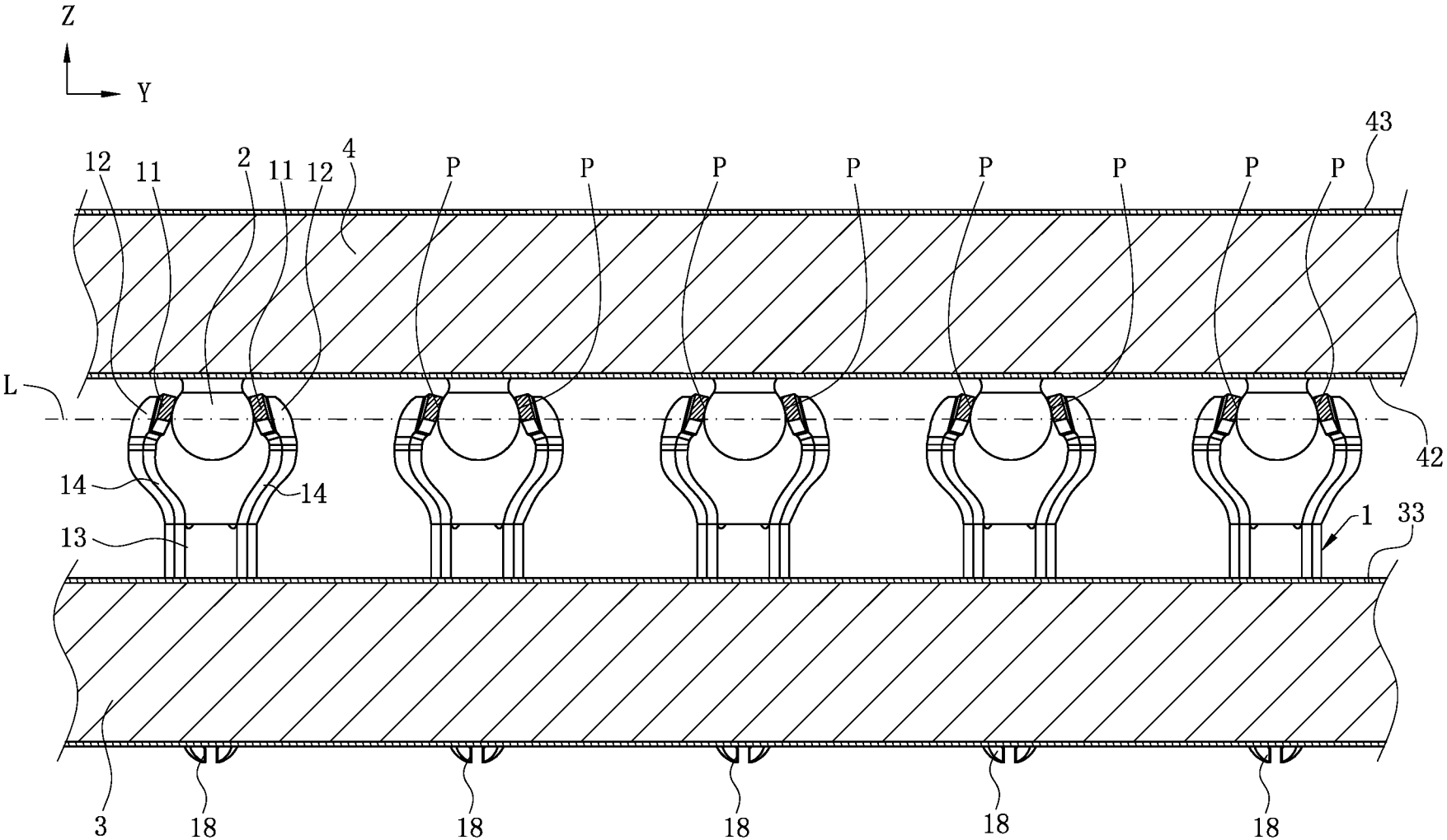
FIG. 6 is a sectional view of FIG. 5 along the A-A direction.
Figure 9:
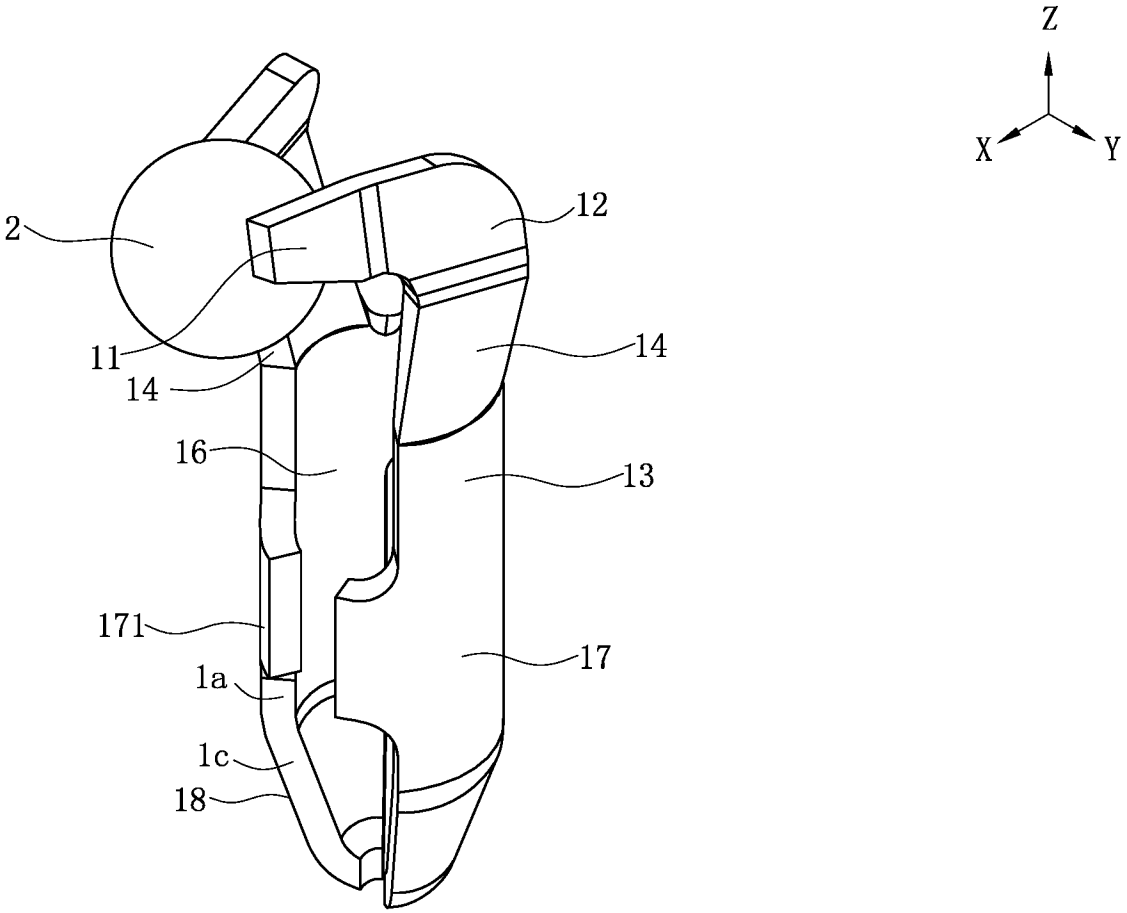
FIG. 9 is a perspective view of a terminal clamping a corresponding insertion portion according to certain embodiments of the present invention.
Figure 10:
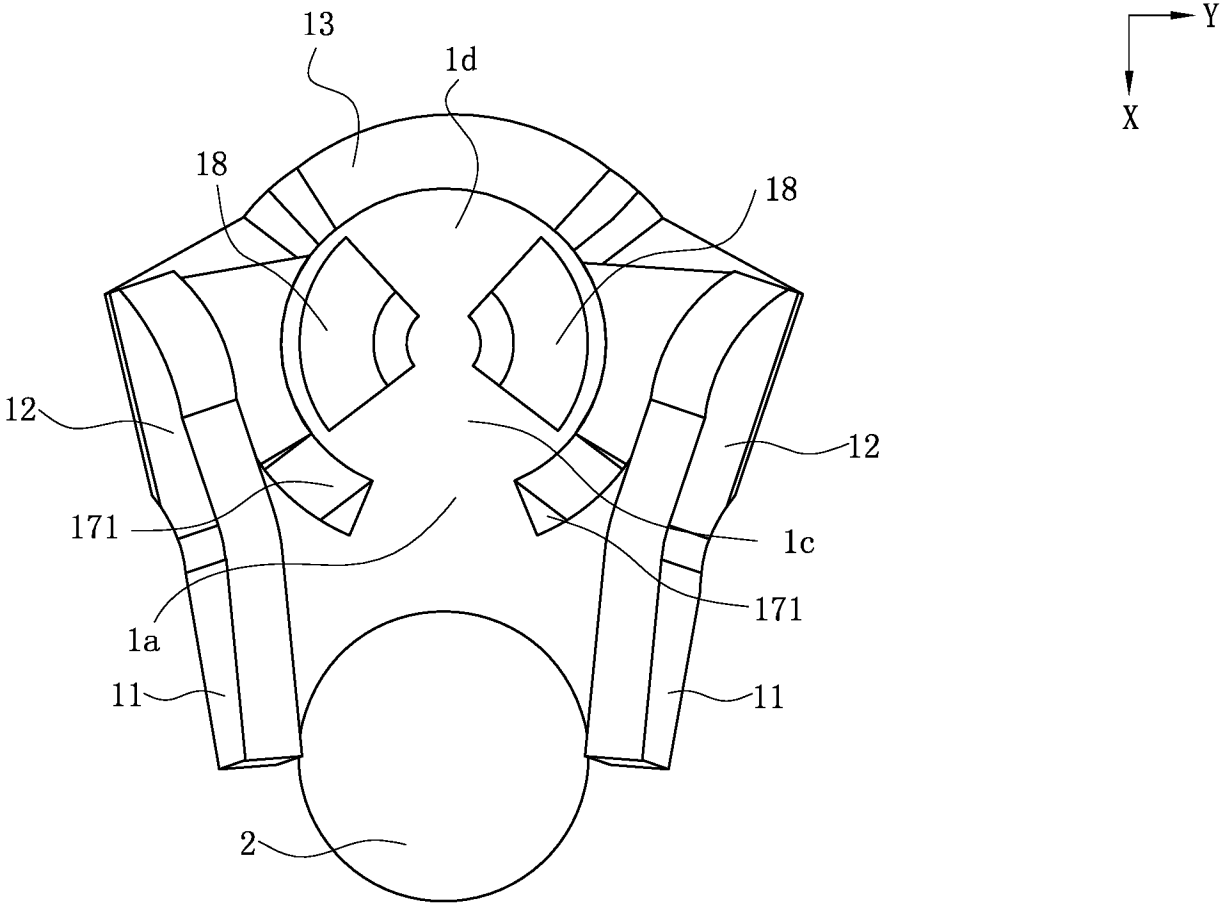
FIG. 10 is a top view of FIG. 9.
Figure 11:
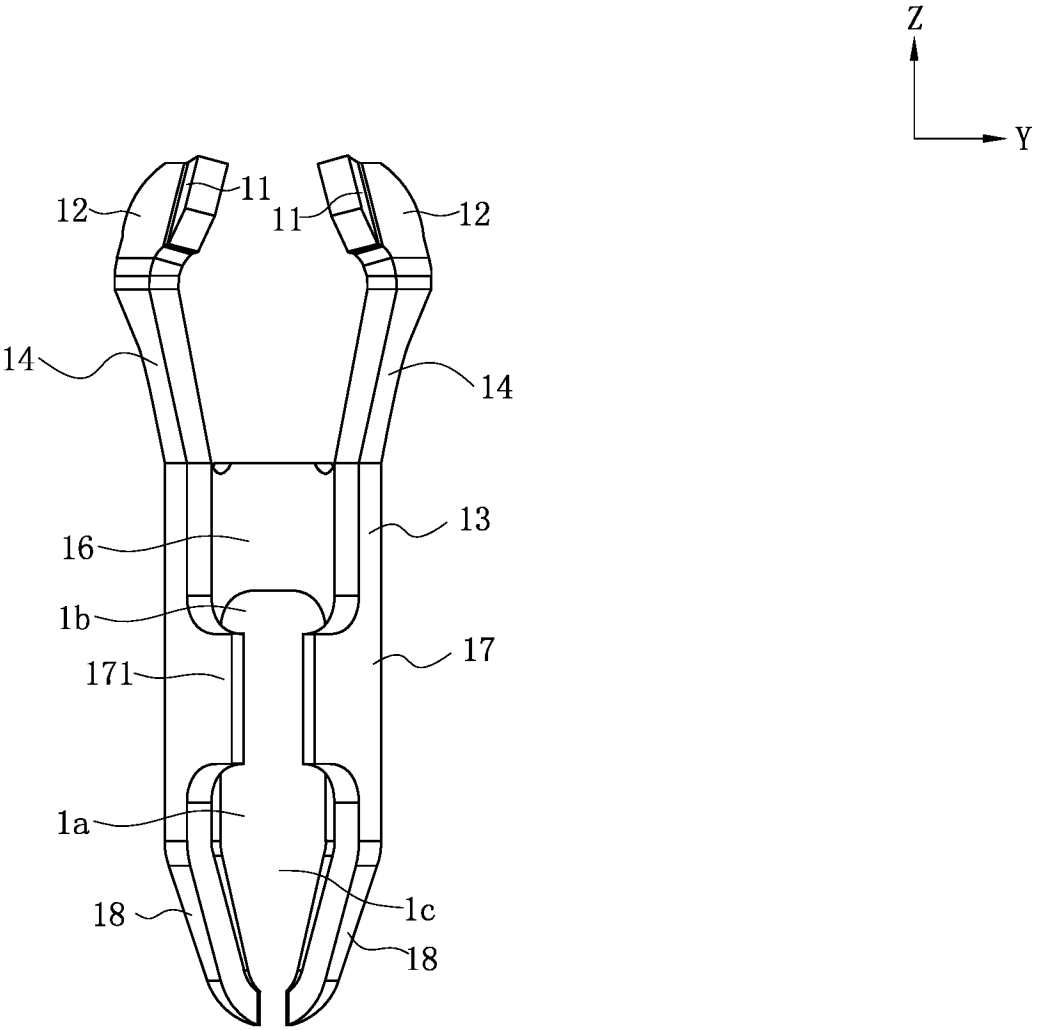
FIG. 11 is a main view of a terminal according to certain embodiments of the present invention.
Figure 12:
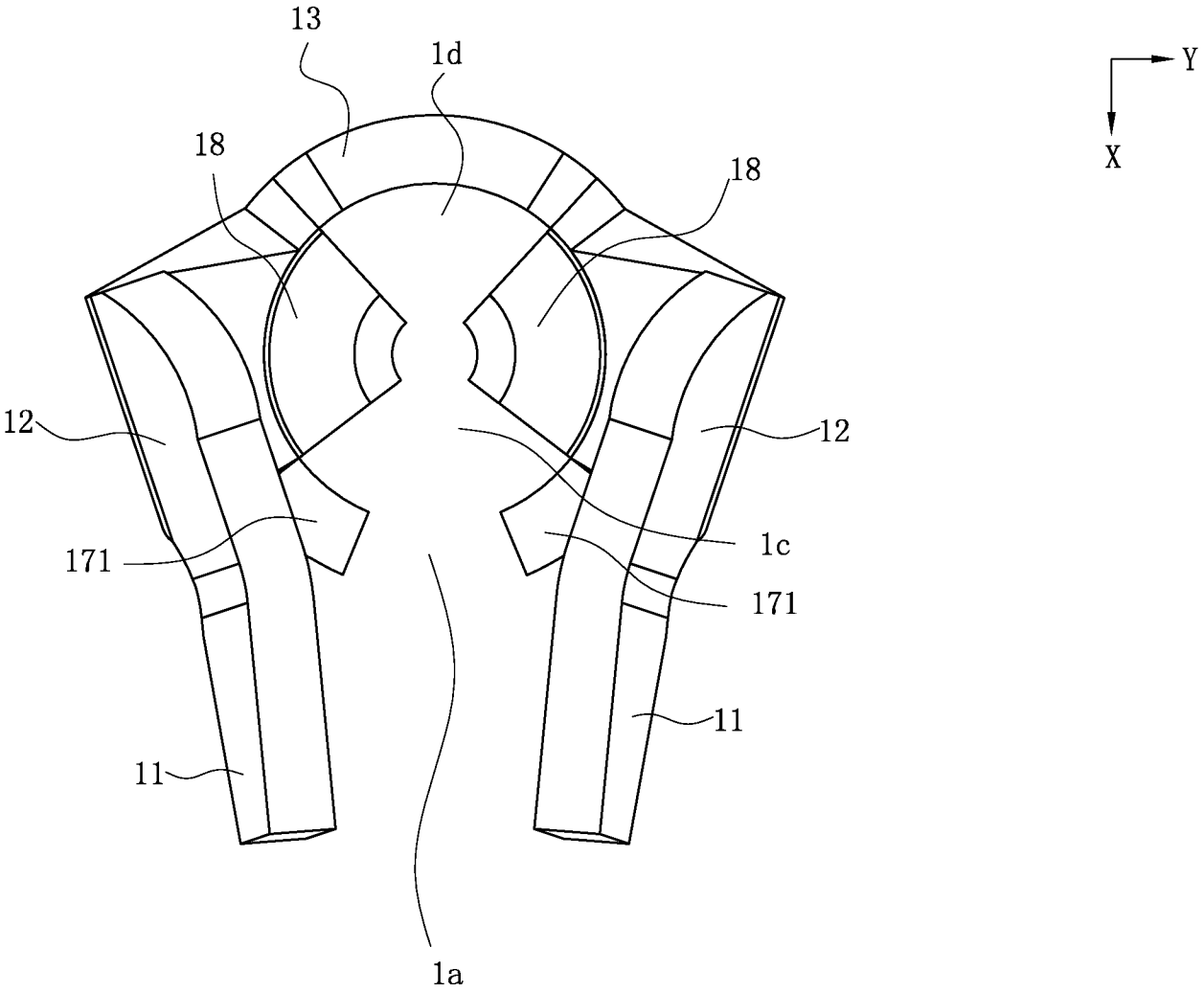
FIG. 12 is a top view of FIG. 11.
Figure 13:
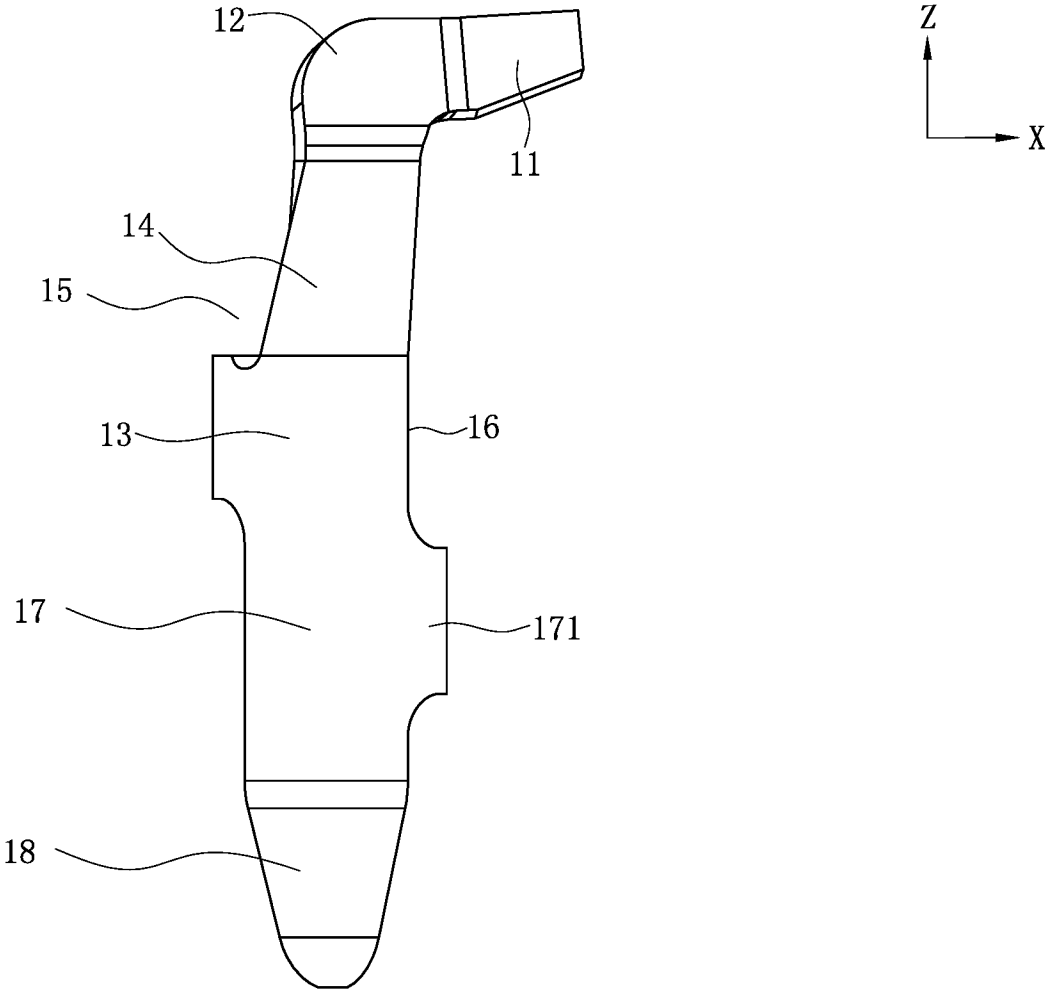
FIG. 13 is a left view of FIG. 11.

As shown in FIG. 9, FIG. 10, and FIG. 13, each terminal 1 has a base 13, which is ring-shaped, and a notch 16 is formed in a front side of the base 13. Two connecting portions 14 extend upward from the base 13. The terminal 1 further has two guide portions 12 and two clamping portions 11. The guide portions 12 are connected to the connecting portions 14, and the clamping portions 11 are formed by extending forward from the guide portions 12. The two clamping portions 11 are configured to clamp a corresponding insertion portion 2. A distance between the two guide portions 12 is greater than a distance between the two clamping portions 11, such that the distance between the two guide portions 12 is greater than a diameter of the insertion portion 2, thereby facilitating the insertion portion 2 to insert downward between the two guide portions 12 with zero insertion force, and then the guide portions 12 guide the insertion portion 2 to horizontally move to the clamping portions 11 (as shown in FIG. 4, FIG. 11 and FIG. 12). As shown in FIG. 3 and FIG. 11, along an upward direction from bottom thereof, the connecting portions 14 expand outward (and in other embodiments, only a portion of the connecting portions 14 may expand outward), and the guide portions 12 incline inward. That is, a distance between the two connecting portions 14 gradually increases upward from bottom thereof, and a distance between the two guide portions 12 gradually decreases upward from bottom thereof, such that the distance between the two clamping portions 11 gradually decreases upward from bottom thereof, and as shown in FIG. 3 and FIG. 6, a position P where the clamping portions 11 clamp the insertion portion 2 is higher than a virtual horizontal center line L of the insertion portion 2. When the insertion portion 2 is clamped by the clamping portions 11, if the position P where the clamping portions 11 clamp the insertion portion 2 is lower than the virtual horizontal center line L of the insertion portion 2, the insertion portion 2 is pushed by an upward pushing force of the clamping portions 11, thereby causing the chip module 500 to move upward. Therefore, in this embodiment, the position P where the clamping portions 11 clamp the insertion portion 2 is higher than the virtual horizontal center line L of the insertion portion 2, such that the clamping portions 11 form a downward pressure to the insertion portion 2, thereby avoiding upward movement of the chip module 500 due to an upward pushing force applied to the insertion portion 2. An accommodating space 15 is provided right above the base 13, and the accommodating space 15 is located behind the guide portions 12. As shown in FIG. 3, when the insertion portion 2 is clamped by the clamping portions 11, a portion of the insertion portion 2 lower than the top ends of the clamping portions 11 protrudes forward from the clamping portions 11 and is accommodated in the accommodating space 15 of an adjacent terminal 1. That is, the portion of the insertion portion 2 lower than the top ends of the clamping portions 11 is located right above the base 13.

As shown in FIG. 7, FIG. 8 and FIG. 9, the base 13 is located outside the corresponding accommodating hole 31, and two fixing portions 17 extend downward from the base 13. (In another embodiment, there may be only one fixing portion 17.) The front ends of the clamping portions 11 pass forward beyond the fixing portions 17. As shown in FIG. 7, the fixing portions 17 and a corresponding accommodating hole 31 are in interference fit to fix the terminal 1 to the corresponding accommodating hole 31. As shown in FIG. 8, the surfaces of the fixing portions 17 are arc surfaces matching the inner wall of the corresponding accommodating hole 31, such that the fixing portions 17 and the inner wall of the accommodating hole 31 have a larger contact surface area, and the terminal 1 is more firmly fixed to the substrate 3. Two protruding portions 171 are provided at the front sides of the two fixing portions 17 protrudingly opposite to each other. A first through slot **1*a* is formed between the front sides of the two fixing portions 17, and a second through slot 1*b* is formed between the rear sides of the two fixing portions 17. A protruding portion 171 protrudes from the front side of each of the fixing portions 17 toward the first through slot 1*a*, and the two protruding portions 171 of each of the terminals 1** extend toward each other.

As shown in FIG. 7, FIG. 8 and FIG. 9, each terminal 1 further has two conducting portions 18 provided separately (in other embodiments, thereby may be only one conducting portion 18). The conducting portions 18 extend obliquely downward from the fixing portions 17 to guide the terminal 1 to be inserted into the corresponding accommodating hole 31. A portion of each conducting portion 18 is located in the corresponding accommodating hole 31, and another portion of each conducting portion 18 protrudes from the corresponding accommodating hole 31 to be soldered to the main circuit board 800. A first opening 1*c* is formed between the front sides of the two conducting portions 18, and a second opening 1*d* is formed between the rear sides of the two conducting portions 18. The first through slot 1*a*, the second through slot 1*b*, the first opening 1*c*, and the second opening 1*d* may reduce a cross-sectional area of the terminal 1, increase a characteristic impedance, and improve a high frequency.

Figure 5:
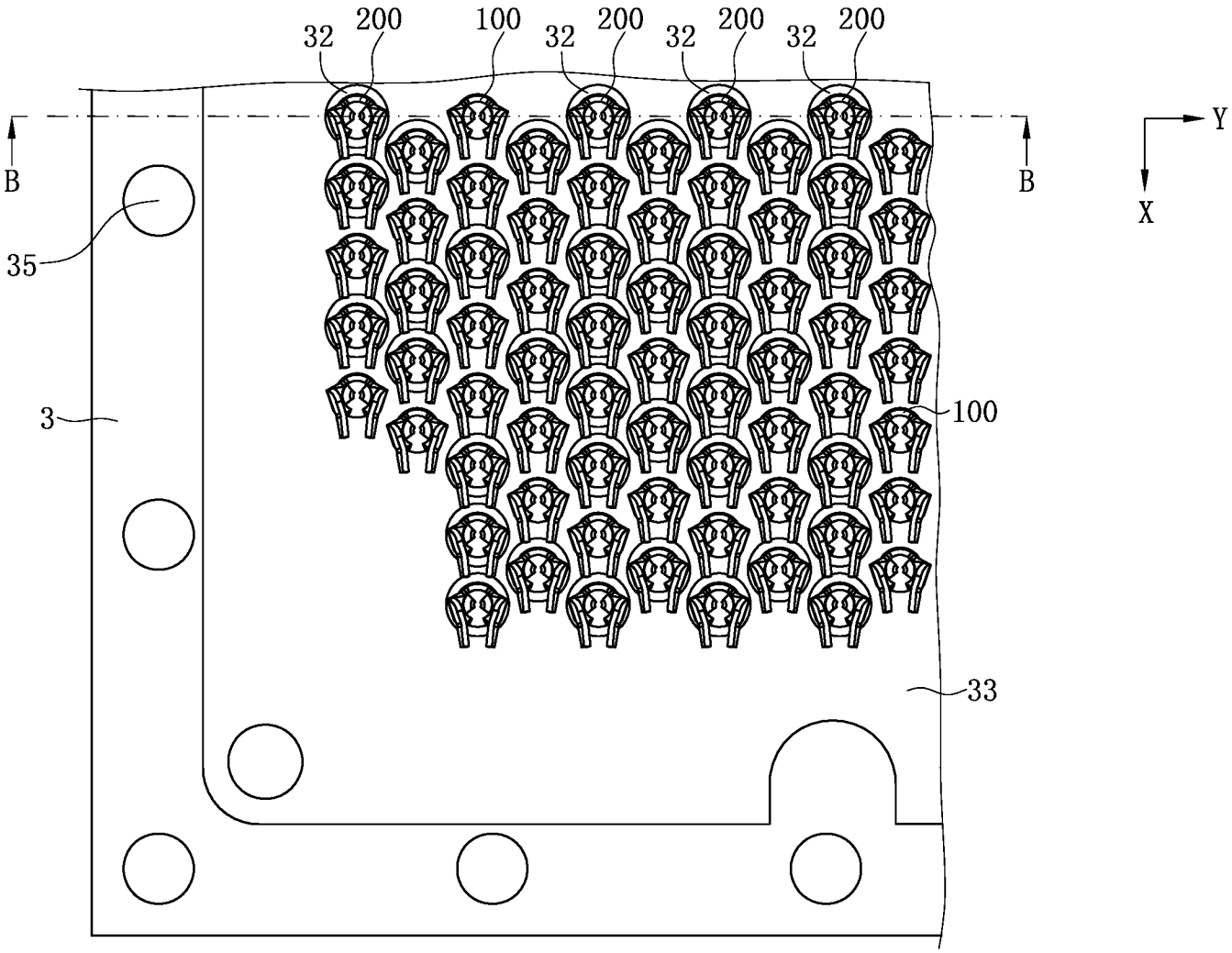
FIG. 5 is a top view of an electrical connector according to certain embodiments of the present invention.
Figure 15:
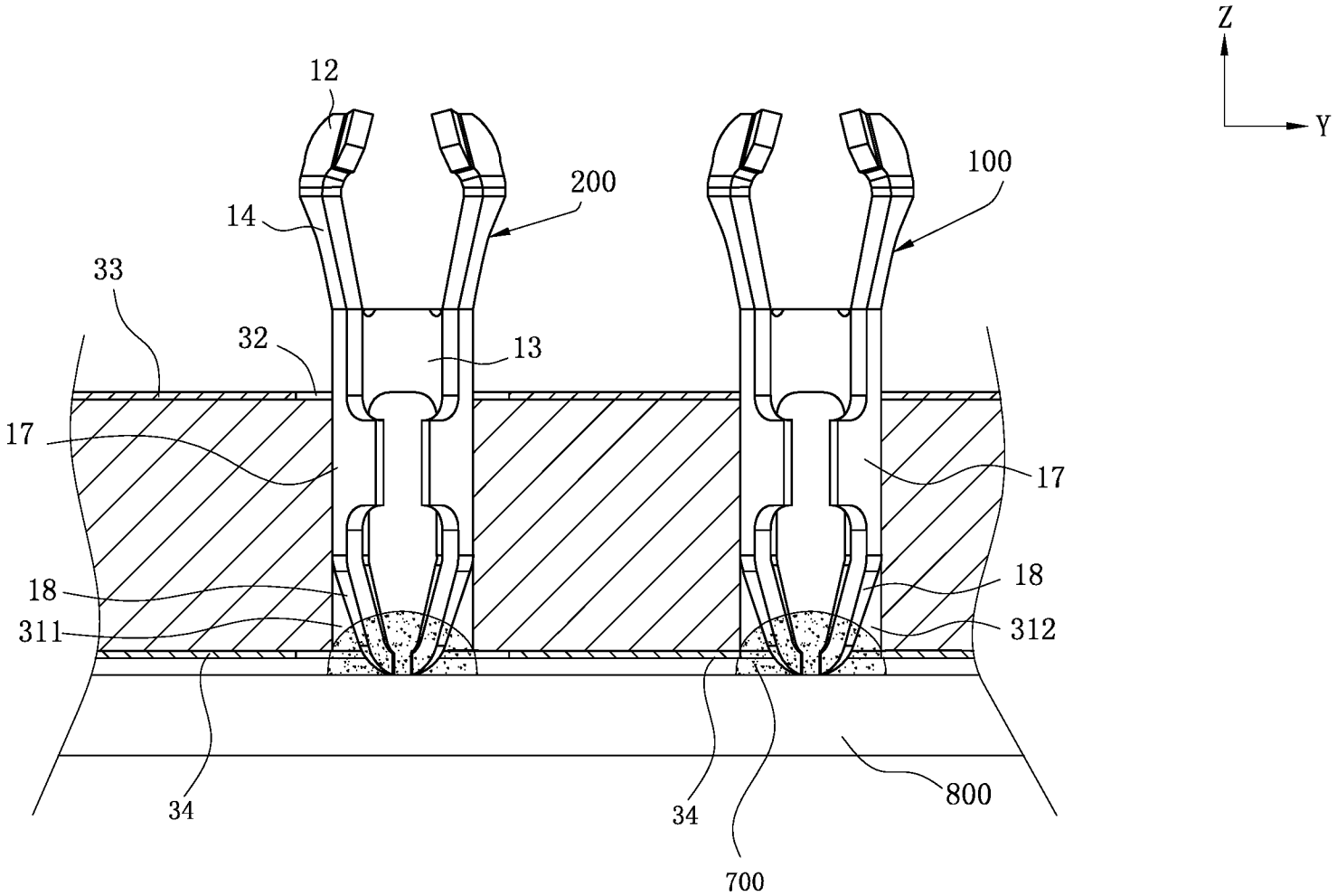
FIG. 15 is a schematic view of terminals being soldered to a main circuit board according to certain embodiments of the present invention.

As shown in FIG. 5 and FIG. 7, the terminals 1 includes a plurality of signal terminals 200 correspondingly accommodated in the first accommodating holes 311 and a plurality of ground terminals 100 correspondingly accommodated in the second accommodating holes 312. The signal terminals 200 are not conductively connected with the third shielding layer 33 and the shielding member 34. Because the third shielding layer 33 covers the upper edges of the second accommodating holes 312, the conducting portions 18 of the ground terminals 100 are closely attached to upper edges of the correspondingly second accommodating holes 312, such that the ground terminals 100 and the third shielding layer 33 are in contact and are electrically connected. As shown in FIG. 15, the conducting portions 18 of the ground terminals 100 are partially located in the correspondingly second accommodating holes 312, such that there are intervals between the conducting portions 18 and lower edges of the second accommodating holes 312. When the conducting portions 18 are soldered to the main circuit board 800 by solders 700, each solder 700 is filled in the intervals between the conducting portions 18 of the ground terminals 100 and the shielding member 34, such that the solders 700 are connected to the shielding member 34 and the conducting portions 18, and the shielding member 34 and the ground terminals 100 are electrically connected. That is, the third shielding layer 33 is electrically connected with the shielding member 34 through the ground terminals 100.

Figure 14:
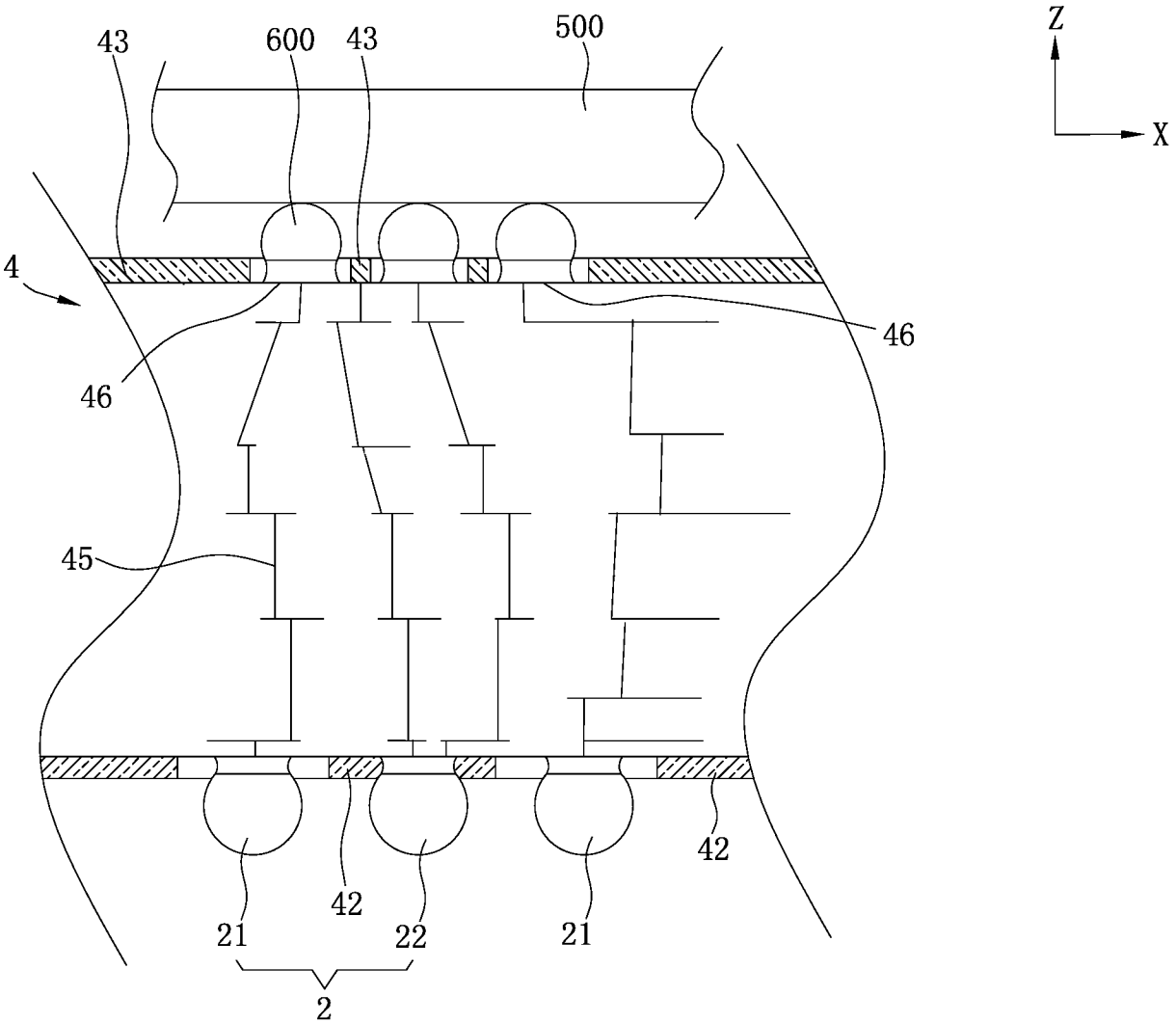
FIG. 14 is a schematic view of a chip module and a support plate being connected according to certain embodiments of the present invention.

As shown in FIG. 1, FIG. 2 and FIG. 14, the support plate 4 is made of a printed circuit board, and specifically can be FR4. There are multiple layers of printed circuits 45 between an upper surface and a lower surface of the support plate 4. A front side surface of the support plate 4 is provided with a stopped portion 41, and a foolproof groove 44 is concavely formed inward from the front side surface of the support plate 4. The lower surface of the support plate 4 has a first shielding layer 42, and the upper surface of the support plate 4 has a second shielding layer 43. As shown in FIG. 1 and FIG. 3, the top portions of the insertion portions 2 are soldered upward to the lower surface of the support plate 4. The insertion portions 2 are made of copper, which may be pure copper or a copper alloy, and is a copper alloy in this embodiment. Specifically, the copper alloy includes 98% of brass and 2% of tin in weight. In addition, surfaces of insertion portions 2 are plated with oxidation resistance coatings, and a material of the coatings is gold. The insertion portions 2 include a plurality of first insertion portions 21 to be clamped by the signal terminals 200 and a plurality of second insertion portions 22 to be clamped by the ground terminals 100. The first shielding layer 42 extends to the second insertion portions 22, such that the first shielding layer 42 and the second insertion portions 22 are conductively connected, and the second insertion portions 22 are connected in series. There are intervals between the first shielding layer 42 and the first insertion portions 21, such that first shielding layer 42 and the first insertion portions 21 are not conductively connected. However, the second shielding layer 43 and the printed circuits 45 are connected, and the printed circuits 45 and the second insertion portions 22 are connected, such that the second shielding layer 43 and the second insertion portions 22 are electrically connected. As shown in FIG. 14, the upper surface of the support plate 4 further has a plurality of soldering regions 46, and the chip module 500 is provided with a plurality of conductors 600 soldered to the soldering regions 46. There are intervals between the conductors 600 and the second shielding layer 43, such that the conductors 600 and the second shielding layer 43 are not conductively connected. The conductors 600 are electrically connected with the insertion portions 2 by multiple layers of the printed circuits 45, and a distance between two adjacent insertion portions 2 is greater than a distance between two adjacent conductors 600, such that there is sufficient space to provide the terminals 1 with a quantity same as a quantity of the conductors 600.

As shown in FIG. 1 and FIG. 2, a blocking frame 5 extends downward to form a plurality of fixing posts 53, corresponding inserted downward into the fixing holes 35 to fix the blocking frame 5 to the substrate 3. The blocking frame 5 has a stopping portion 51 located in front of the stopped portion 41, and has a foolproof portion 52. When the support plate 4 is mounted downward to the electrical connector 300, the foolproof portion 52 is accommodated in the foolproof groove 44 to avoid inverse mounting. The stopping portion 51 overlaps with the stopped portion 41 along the front-rear direction. When each insertion portion 2 moves horizontally to the clamping portions 11, the stopping portion 51 stops the stopped portion 41 forward along a horizontal movement direction of the insertion portion 2.

To sum up, the electrical connector 300 according to certain embodiments of the present invention has the following beneficial effects:

(1) The conducting portions 18 of the ground terminal 100 are connected with the shielding member 34 through the solder 700, such that the ground terminal 100 is electrically connected with the shielding member 34, and there is no need to provide a conductive layer on the inner wall of each of the accommodating holes 31 to electrically connect the ground terminal 100 and the shielding member 34, thereby reducing a spurious charge, reducing the capacitance, and improving a high frequency.

(2) The distance between two clamping portions 11 of each terminal 1 gradually decreases upward from bottom thereof, and the position where the clamping portions 11 clamp the insertion portion 2 is higher than the virtual horizontal center line L of the insertion portion 2, such that the clamping portions 11 form a downward pressure on the insertion portion 2, thereby avoiding the upward movement of the chip module 500 due to an upward pushing force applied to the insertion portion 2.

(3) Each insertion portion 2 is ball-shaped, so the insertion portion 2 has a smaller length and a greater width in the vertical direction, and the insertion portion 2 has sufficient strength to resist against impact of external force, such that the insertion portion 2 is not easily deformed, thereby ensuring good contact between the terminal 1 and the corresponding insertion portion 2. In addition, each insertion portion 2 has a smaller length in the vertical direction, so the lower end of the insertion portion 2 is near a position where the insertion portion 2 is clamped by the clamping portions 11, thus alleviating an open stub effect may be alleviated, and thereby improving a high frequency. Further, each insertion portion 2 is made of copper, so the insertion portion 2 has a high melting point, allowing the insertion portion 2 to sustain a high temperature when the chip module 500 operates without deviating from the clamping portions 11 due to creeps and impacting the stability of the electrical connection between the chip module 500 and the electrical connector 300. In addition, the hardness of copper is good, so an antioxidation coating layer plated on the surface of copper is not easily damaged due to scrapes of the clamping portions 11.

(4) A portion of the insertion portion 2 lower than the top ends of the guide portions 12 protrudes forward from the clamping portions 11 and is accommodated in the accommodating space 15 of the adjacent terminal 1. That is, the portion of the insertion portion 2 lower than the top ends of the clamping portions 11 is located right above the base 13 of the adjacent terminal 1, such that a distance between the two adjacent terminals 1 in the front-rear direction is shortened, and the arrangement of the terminals 1 may be denser.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

a substrate, provided with a plurality of accommodating holes running through the substrate vertically, wherein a shielding member is provided on a lower surface of the substrate; and a plurality of terminals, correspondingly accommodated in the accommodating holes respectively, wherein the terminals comprise a plurality of signal terminals and at least one ground terminal, an interval exists between the ground terminal and the shielding member, the ground terminal has a conducting portion extending downward out of a corresponding one of the accommodating holes, the conducting portion is soldered to a main circuit board through a solder, and the solder is in contact with the conducting portion and the shielding member.

2. The electrical connector according to claim 1, wherein each of the terminals has two clamping portions configured to clamp an insertion portion of a mating component and two guide portions formed by extending backward from the clamping portions respectively, a distance between the two guide portions is greater than a distance between the two clamping portions, each of the terminals further has a base lower than the guide portions and an accommodating space right above the base, the accommodating space is located behind the guide portions, and when the insertion portion is clamped by the clamping portions, a portion of the insertion portion lower than top ends of the guide portions protrudes forwards out of the clamping portions to be accommodated in the accommodating space of an adjacent terminal.

3. The electrical connector according to claim 2, wherein the insertion portion is ball-shaped, the distance between the two clamping portions of each of the terminals gradually decreases upward from a bottom thereof, and a position where the two clamping portions clamp the insertion portion is higher than a virtual horizontal center line of the insertion portion.

4. The electrical connector according to claim 1, wherein each of the terminals has at least one fixing portion fixed to a corresponding one of the accommodating holes, and the conducting portion is formed by inclining inward and extending downward from the fixing portion and is partially accommodated in the corresponding one of the accommodating holes.

5. The electrical connector according to claim 4, wherein each of the terminals has two fixing portions, a first through slot is formed between front sides of the two fixing portions, and a second through slot is formed between rear sides of the two fixing portions.

6. The electrical connector according to claim 4, wherein each of the terminals has two conducting portions provided separately, a first opening is formed between front sides of the two conducting portions, and a second opening is formed between rear sides of the two conducting portions.

7. The electrical connector according to claim 4, wherein a cross section of each of the accommodating holes is circular, and a surface of the fixing portion is an arc-shaped surface matched with an inner wall of the corresponding one of the accommodating holes.

8. The electrical connector according to claim 4, wherein each of the terminals has two fixing portions, and two protruding portions are respectively provided to protrude from the front sides of the two fixing portions opposite to each other.

9. The electrical connector according to claim 1, wherein the shielding member is a metal coating layer, and an inner wall of each of the accommodating holes is insulating.

10. The electrical connector according to claim 1, wherein a shielding layer is provided on an upper surface of the substrate, the shielding layer is in contact with the ground terminal, and the shielding member is electrically connected with the shielding layer through the ground terminal.

* * * * *